United States Patent [19]

Huiatt et al.

[11] 4,231,859

[45] Nov. 4, 1980

[54] MOLYBDENITE FLOTATION

[75] Inventors: Jerry L. Huiatt, Murray; Melvin D. Shurtz, Orem, both of Utah; George M. Potter, Tucson, Ariz.

[73] Assignee: The United States of America as represented by the Secretary of the Interior, Washington, D.C.

[21] Appl. No.: 97,751

[22] Filed: Nov. 27, 1979

Related U.S. Application Data

[63] Continuation-in-part of Ser. No. 900,838, Apr. 28, 1978, abandoned.

[51] Int. Cl.[3] ..... B03B 1/00

[52] U.S. Cl. ..... 209/11; 209/167

[58] Field of Search ..... 209/3, 167, 11, 166, 209/4

[56] References Cited

U.S. PATENT DOCUMENTS

| | | | |
|---|---|---|---|
| Re. 22,117 | 6/1942 | Janney | 209/3 |
| 1,102,738 | 7/1914 | Greenway | 209/167 |
| 1,261,810 | 4/1918 | Hebhard | 209/167 |
| 1,274,505 | 8/1918 | Bradford | 209/167 |
| 2,559,104 | 7/1951 | Arbiter | 209/167 X |
| 2,608,298 | 8/1952 | Arbiter | 209/167 |
| 2,811,255 | 10/1957 | Nokes | 209/167 |
| 2,957,576 | 10/1960 | Henderson | 209/167 |
| 3,426,896 | 2/1969 | Baavson | 209/167 |
| 3,539,002 | 11/1970 | Last | 209/167 X |

OTHER PUBLICATIONS (Strelskaya) Russian, 209/167, pp. 637–642, 12/1974, New Tech. Sepr. of Collective Molybdenite Containing Concentrates.

U.S. Bur. of Mines Publication, Bur. of Mines Research 1975, p. #16, Huiatt et al.

*Primary Examiner*—Robert Halper

*Attorney, Agent, or Firm*—William S. Brown; Donald A. Gardiner

[57] ABSTRACT

Molybdenite ($MoS_2$) is recovered from copper sulfide flotation concentrates by froth flotation utilizing steam-air injection into the concentrate flotation pulp at a temperature of about 70° to 100° C. in the presence of activated carbon and soluble sulfide reagents.

1 Claim, No Drawings

MOLYBDENITE FLOTATION

This application is a continuation-in-part of application Ser. No. 900,838, filed Apr. 28, 1978 now abandoned.

Froth flotation is conventionally used for initial molybdenite separation from primary copper sulfide flotation concentrates. Conventional processes are, however, generally complicated, expensive, and variable because of undesirable factors such as oxide coatings on the molybdenite surfaces, natural floatability of a portion of the copper mineral surfaces, and residual collector reagents from the primary copper-molybdenum flotation circuit.

It has now been found, according to the process of the invention, that a substantially more efficient and economical recovery of molybdenite from primary copper sulfide concentrates may be achieved by means of a process in which steam is injected into the concentrate flotation pulp both prior to and during molybdenite flotation. In addition, it has been found that the presence of activated carbon in the pulp is essential to optimum molybdenite recovery and grade. Injection of steam into the pulp prior to molybdenite flotation alters copper and iron sulfide mineral surfaces so that they are less naturally floatable, decomposes residual flotation reagents that promote copper and iron sulfide flotation, and reduces sulfide reagent consumption by lowering the solubility of dissolved oxygen. Addition of steam during molybdenite flotation maintains the required pulp temperature, i.e., from about 70 to 100° C., thus also preventing an increase in dissolved oxygen content in the pulp, thereby reducing soluble sulfide reagent consumption.

The presence of the activated carbon has been found to be of prime importance since it absorbs both residual copper or iron sulfide mineral flotation reagents and decomposition products resulting from the thermal treatment of the flotation pulp, as well as any excess frothing agents. The combined technique of steam injection into the pulp, and activated carbon addition to adsorb harmful reagents produces higher molybdenite recoveries and grades in the rougher flotation step than are normally obtained by single stage cleaning of rougher concentrates.

The feed material in the process of the invention consists of copper sulfide concentrates obtained by conventional flotation separation of copper sulfide minerals from copper ores such as chalcopyrite, chalcocite, bornite, and covelite. These concentrates typically also contain minor amounts of other metal sulfides, incuding iron sulfides and molybdenite. An aqueous pulp of the concentrate, containing about 20 to 60 percent solids, is initially introduced to a suitable vessel. A pressurized vessel improves gas absorption; however, an open conditioning tank can be used.

Activated carbon, conveniently in the form of an aqueous slurry, is added to the agitated pulp in an amount of about 0.2 to 1 pound of the dry activated carbon per dry ton of feed. The carbon is employed in a finely divided form, preferably of about minus 150 mesh size. Larger amounts of the carbon, e.g., up to about 2 pounds per ton of feed, can be used but generally offer no advantage over the smaller amounts.

Steam is then injected into the carbon-containing pulp in any conventional manner, e.g., by means of lances, until the pulp temperature rises to about 70° to 100° C. External or immersion heaters may also be used initially or simultaneously to facilitate heating the pulp to the desired temperature. The pulp is then maintained at this temperature, with continued steam injection, for a time sufficient to decrease copper and iron sulfide floatability and to reduce sulfide reagent consumption. The optimum amount and time period of steam injection will depend on the specific feed material and reagents used in the primary copper circuit. For example, xanthates readily decompose and require less heat treatment, whereas alkyl dithiophosphates are more stable and, therefore, require longer heating periods. Generally, however, steam injection for a period of about 10 to 60 minutes, at a rate sufficient to maintain the temperature at about 70° to 100° C., is sufficient.

Soluble sulfide reagent, which acts as a depressant for copper and iron sulfide minerals, is added to the hot pulp, and the pulp is conditioned with agitation, and with continued steam injection, for a period of about 0.5 to 3 minutes. The conditioning period should not substantially exceed 3 minutes since the small amount of residual oxygen in the pulp consumes the sulfide reagent to a level where the sulfide ion concentration is too low to depress copper or iron sulfide minerals. Suitable sulfide reagents include sodium sulfide, sodium hydrosulfide, ammonium sulfide, calcium sulfide, Nokes reagents, polysulfides and other soluble inorganic sulfide salts. Suitable amounts of the sulfide reagents will generally be about 2.5 to 12.5 pounds per dry ton of feed depending on the type of reagent added. Mixtures of different sulfide reagents may also be used. In addition, sequential conditioning periods, using the same or different sulfide reagents, may provide best results with a given feed.

It may also be desirable to add a molybdenite collector reagent, such as fuel oil No. 2, vapor oil, or other nonpolar hydrocarbons, to the hot pulp prior to conditioning. A preliminary collector reagent conditioning period of about 1 to 3 minutes, prior to addition of the sulfide reagent, may also be desirable for use with certain types of feed.

The hot pulp is transferred to a flotation cell and molybdenite is then floated from the hot pulp for a period of about 2 to 5 minutes using an air-steam mixture for flotation aeration. The air-steam mixture is added through the air intake port of the flotation apparatus. As mentioned above, injection of steam with the flotation air maintains low oxygen solubility in the pulp, thus prolonging the depressing action of the sulfidizing agent. It may also be necessary, or desirable, to add additional soluble sulfide reagent, e.g., about 4 to 8 pounds per dry ton of feed, prior to flotation to ensure sufficient sulfide ion concentration for depression of copper and iron sulfide minerals. Addition of a frothing agent, such as methylisobutyl carbinol, may also be required for efficient flotation.

The molybdenite rougher concentrate obtained by the above process can be cleaned by repeating the same flotation procedure, or by conventional procedures employing inorganic cyanide compounds, sulfidizing agents or chemical oxidants to depress copper sulfide minerals.

The process of the invention will be more specifically illustrated by the following examples. The invention is, however, not limited to these examples, any many variations in the procedures will be apparent to those skilled in the art. For convenience, the flotation cell in these examples was used both as a conditioning vessel and as a flotation cell. Commercial application of the process would ordinarily require separate equipment for conditioning and flotation.

EXAMPLE 1

Five hundred grams of molybdenite-bearing chalcopyrite concentrate containing, in percent, 26 copper and 0.4 molybdenum, was pulped to 50 percent solids with tap water in a Fagergren flotation cell and 0.5 pound of fine activated carbon per ton of dry chalcopyrite concentrate feed was added as a slurry to the pulp. The pulp was heated to 75° C. by injecting steam through an immersed lance and through the air intake port of the flotation agitator. Additional heating was provided by an electric immersion heater which was removed when the pulp temperature reached 75° C. About 10 minutes of heating and steam injection were required to bring the pulp to temperature. The pulp was then conditioned with continued steam injected for a period of 10 minutes.

With continuous steam injection, the pulp was then conditioned 2 minutes with 0.034 pound of fuel oil No. 2 per ton of feed, followed by 2-minute conditioning with 4.0 pounds ammonium sulfide per ton. The pulp was conditioned a second time for 1 minute using 8.0 pounds sodium sulfide (60 percent) per ton. Methylisobutyl carbinol frother was added as needed and a molybdenite rougher concentrate was floated from the pulp for 2 minutes using a steam-air mixture for flotation aeration. The results of this test, plus results of a control test, are listed in the following table. In the control test, all conditions were the same except pulp heating and steam injection were excluded.

TABLE 1

| | Molybdenum rougher flotation | | | |
|---|---|---|---|---|
| | Assay, wt pct | | Distribution, pct | |
| Method | Mo | Cu | Mo | Cu |
| Control | 7.8 | 24.3 | 74.8 | 3.4 |
| Steam Injection | 12.2 | 16.1 | 84.4 | 1.6 |

EXAMPLE 2

A 500-gram sample of the same chalcopyrite concentrate used in example 1 was treated according to the procedure described in example 1, except 8.8 pounds ammonium sulfide per ton of feed was used as the sulfidizing agent in the initial sulfidizing step and 8.0 pounds of sodium hydrosulfide per ton of feed was used in the second sulfidizing step. A control test using ammonium sulfide and sodium hydrosulfide was also performed. Comparative results are listed in the following table:

TABLE 2

| | Molybdenum rougher flotation | | | |
|---|---|---|---|---|
| | Assay, wt pct | | Distribution, pct | |
| Method | Mo | Cu | Mo | Cu |
| Control | 7.8 | 21.9 | 71.8 | 2.7 |
| Steam Injection | 15.2 | 13.3 | 77.7 | 1.0 |

EXAMPLE 3

Five hundred grams of chalcopyrite concentrate containing, in percent, 29 copper and 0.74 molybdenum, was treated by the procedure described in example 1, except dosages of 8.0 pounds sodium hydrosulfide per ton of feed were used in the initial and in the second sulfidizing step. The results of this test, including control test data, are listed in the following table:

TABLE 3

| | Molybdenum rougher flotation | | | |
|---|---|---|---|---|
| | Assay, wt pct | | Distribution, pct | |
| Method | Mo | Cu | Mo | Cu |
| Control | 18.1 | 21.5 | 89.4 | 2.8 |
| Steam Injection | 29.6 | 13.7 | 94.4 | 1.2 |

EXAMPLE 4

A 500-gram sample of the same chalcopyrite concentrate used in example 3 was treated according to the procedure described in example 1, except 12.5 pounds polysulfide reagent per ton of feed was used as the sulfidizing agent in the initial sulfidizing step and in the second sulfidizing step. The polysulfide was synthesized by refluxing 1 mole of elemental sulfur per liter of water with 2 moles of NaOH per liter of water. The results of this test, and control test results, are listed in the following table:

TABLE 4

| | Molybdenum rougher flotation | | | |
|---|---|---|---|---|
| | Assay, wt pct | | Distribution, pct | |
| Method | Mo | Cu | Mo | Cu |
| Control | 22.8 | 15.9 | 91.4 | 1.7 |
| Steam Injection | 31.4 | 14.6 | 96.1 | 1.1 |

EXAMPLE 5

A 750-gram sample of chalcocite-chalcopyrite concentrate containing, in percent, 20.0 copper, 4.9 molybdenum, and 26.3 iron, was treated according to the procedure described in example 1, except (1) water from the molybdenite flotation circuit was used for pulping instead of tap water, (2) dosages of 8.0 pounds of sodium hydrosulfide per ton of feed were used in the initial and in the second sulfidizing step, and (3) a rougher molybdenite concentrate was flotated from the pulp for 4 minutes. The rougher concentrate was cooled to ambient temperature and subjected to a 4½ minute cleaner flotation using 0.2 pound sodium cyanide per ton original chalcocite-chalcopyrite feed. Results are listed with control test results in the following table:

TABLE 5

| | | Molybdenum rougher and cleaner flotation | | | | | |
|---|---|---|---|---|---|---|---|
| | | Assay, wt pct | | | Distribution, pct | | |
| Method | Product | Mo | Cu | Fe | Mo | Cu | Fe |
| Control | Rougher concentrate | 15.4 | 17.5 | 20.1 | 93.8 | 26.4 | 23.8 |
| Control | Cleaner concentrate | 15.8 | 17.9 | 19.8 | 89.4 | 25.1 | 21.7 |
| Steam Injection | Rougher concentrate | 42.0 | 5.6 | 4.6 | 94.3 | 3.1 | 1.9 |
| Steam Injection | Cleaner concentrate | 47.0 | 3.4 | 2.6 | 89.2 | 1.6 | 0.9 |

EXAMPLE 6

A 250-gram sample of chalcocite concentrate containing, in percent, 14.7 copper and 1.4 molybdenum, was treated in the same manner described in example 1, except (1) a 1-liter mineral separation cell was employed instead of the Fagergren cell, and (2) dosage of 2.5 pounds Anamol D (Nokes reagent) per ton of feed were used as the sulfidizing reagent in the initial and in the final sulfidizing steps. The results of this test plus a control test are listed in the following table:

TABLE 6

| Molybdenum rougher flotation | | | | |
|---|---|---|---|---|
| | Assay, wt pct | | Distribution, pct | |
| Method | Mo | Cu | Mo | Cu |
| Control | 5.2 | 34.3 | 95.8 | 53.3 |
| Steam Injection | 30.6 | 3.6 | 96.2 | 2.1 |

EXAMPLE 7

A 500-gram sample of the chalcocite concentrate used in example 6 was treated according to the procedure described in example 1, except dosages of 8.0 pounds sodium hydrosulfide per ton of feed were used in the initial and in the final sulfidizing steps. The results of this test and a control test are listed in the following table:

TABLE 7

| Molybdenum rougher flotation | | | | |
|---|---|---|---|---|
| | Assay, wt pct | | Distribution, pct | |
| Method | Mo | Cu | Mo | Cu |
| Control | 25.4 | 4.1 | 89.9 | 4.5 |
| Steam Injection | 40.6 | 2.7 | 97.9 | 0.6 |

EXAMPLE 8

Part A: A 500-gram sample of chalcopyrite concentrate containing, in percent, 28.7 copper and 0.74 molybdenum, was treated according to the procedure described in example 1, except dosages of 8.0 pounds sodium sulfide (60 percent) per ton of feed were used in both the initial and second sulfidizing steps.

Part B: Part A was repeated except no activated carbon was added to the system.

Parts C and D: The procedures in parts A and B were repeated except that the pulp was not heated and steam was not injected.

The results of these tests are listed in the following table:

TABLE 8

| Molybdenum rougher flotation with and without activated carbon | | | | | | |
|---|---|---|---|---|---|---|
| | | Activated carbon | Grade, wt pct | | Distribution, pct | |
| Part | Method | lb/ton | Mo | Cu | Mo | Cu |
| A | Steam Injection | 0.5 | 37.8 | 9.1 | 92.3 | 0.6 |
| B | Steam Injection | 0.0 | 13.7 | 13.7 | 81.7 | 0.9 |
| C | Control | 0.5 | 20.5 | 20.0 | 83.4 | 2.2 |
| D | Control | 0.0 | 9.8 | 22.4 | 89.0 | 5.1 |

EXAMPLE 9

The rougher concentrates produced in example 2 were subjected to a 4-minute cleaner flotation at ambient temperature using 0.2 pound sodium cyanide per ton of original chalcopyrite concentrate feed. The results of tests from example 2 and this example are listed in the following table:

TABLE 9

| Molybdenum rougher and cleaner flotation | | | | | |
|---|---|---|---|---|---|
| | | Assay, wt pct | | Distribution, pct | |
| Method | Product | Mo | Cu | Mo | Cu |
| Control | Rougher concentrate | 7.8 | 21.9 | 71.8 | 2.7 |
| Control | Cleaner concentrate | 11.3 | 18.7 | 63.9 | 1.4 |
| Steam Injection | Rougher concentrate | 15.2 | 13.3 | 77.7 | 1.0 |
| Steam Injection | Cleaner concentrate | 23.4 | 4.6 | 71.4 | 0.2 |

We claim:

1. A process for recovering molybdenite from copper sulfide flotation concentrates containing minor amounts of iron sulfide comprising (1) preparing an aqueous pulp comprising the concentrate and about 0.2 to 1 pound of activated carbon per ton of concentrate, (2) injecting steam into the pulp in an amount and for a time sufficient to raise the temperature to about 70° to 100° C. and to maintain the pulp at this temperature for a period of about 10 to 60 minutes, (3) continuing steam injection while adding to the hot pulp an amount of soluble sulfide reagent sufficient to depress copper and iron sulfides, and conditioning the mixture for a period of about 0.5 to 3 minutes with continued steam injection, and (4) injecting a mixture of steam and air into the hot pulp in an amount sufficient for continued maintenance of the temperature of about 70° to 100° C. and to float a rougher molybdenite concentrate.

* * * * *